United States Patent [19]

Raskin

[11] 4,002,200

[45] Jan. 11, 1977

[54] EXTENDED FIN HEAT EXCHANGER PANEL

[75] Inventor: Walter Raskin, Brooklyn, N.Y.

[73] Assignee: Dean Products, Inc., Brooklyn, N.Y.

[22] Filed: Dec. 23, 1974

[21] Appl. No.: 535,505

Related U.S. Application Data

[63] Continuation of Ser. No. 313,180, Dec. 7, 1972, abandoned.

[52] U.S. Cl. ..... 165/131; 29/157.3 V; 165/170

[51] Int. Cl.[2] ..... F24H 3/00; F28F 3/14

[58] Field of Search ..... 165/131, 170; 62/523; 29/157.3 V

[56] References Cited

UNITED STATES PATENTS

| | | | |
|---|---|---|---|
| 1,726,458 | 8/1929 | Tellander | 165/170 |
| 2,626,130 | 1/1953 | Raskin | 165/170 |
| 2,918,262 | 12/1959 | Brandi | 165/131 X |
| 3,458,917 | 8/1969 | Mueller | 29/157.3 V |

FOREIGN PATENTS OR APPLICATIONS

| | | | |
|---|---|---|---|
| 691,538 | 7/1964 | Canada | 165/170 |
| 87,908 | 12/1959 | Denmark | 165/131 |
| 570,951 | 12/1957 | Italy | 165/131 |
| 180,737 | 4/1936 | Switzerland | 165/131 |
| 1,018,525 | 1/1966 | United Kingdom | 165/170 |
| 905,490 | 9/1962 | United Kingdom | 29/157.3 V |

*Primary Examiner*—Albert W. Davis, Jr.
*Assistant Examiner*—Sheldon Richter
*Attorney, Agent, or Firm*—Eric Y. Munson

[57] ABSTRACT

A heat exchanger panel formed from two superimposed plates, at least one of which is folded on itself longitudinally to create a series of outwardly extending open-looped fins, serving as multiple ducts to provide free passage and direct prime heat-exchanging fluid contact along the entire inner wall surface of the fins.

4 Claims, 8 Drawing Figures

EXTENDED FIN HEAT EXCHANGER PANEL

This is a continuation, of application Ser. No. 313,180 filed 12/7/72, now abandoned.

BACKGROUND OF THE INVENTION

Conventional finned heat exchanger panels, by virtue of their fins, increase the available heat-exchanging surface several-fold, but most of the increase is secondary, out-of-direct contact with the heat exchange fluid passing through. The capacity of these panels is usually limited to a heat exchange coefficient K in the range of 1.1 BTU per sq. ft. of surface times the difference in temperature between the heat exchanger and the surrounding air.

Prior art heat exchanger panels also have the inherent disadvantages of tending to become fouled outside with use, and are difficult to clean because of the many sharp edges and corners characteristic of secondary finned surface.

SUMMARY OF THE INVENTION

The present invention provides an extended fin panel of strikingly high heat exchange efficiency, at the same time eliminating the disadvantage of the prior art.

The novel open-looped longitudinal fins of this invention expose virtually their entire inner surface to direct prime contact with the heat-exchange fluid passing through them. As a result, the heat exchange capacity of panels constructed in this manner is more than double that of conventional secondary-finned panels — i.e. a heat exchange coefficient K of approximately 2.5 BTU per sq. ft. of surface times the difference in temperature between the heat-exchanger panel and the ambient air. Thus, an open-finned panel made according to this invention will provide at least equivalent heat exchange capacity to a conventional finned panel at least twice its size.

The open configuration of the looped fins make them far less likely to become fouled, and even if some fouling does occur eventually, it will reduce heat exchange capacity at a much slower rate than in conventionally designed finned panels. In addition, the smoothly rounded outer surfaces of this invention's panels make their cleaning relatively easy.

Heat exchanger panels produced in accordance with this invention are suitable for heating or cooling with a wide range of interacting media, and may be connected together by transition pipes or stacked in various ways against a tube sheet or plenum chamber in the conventional manner.

The concepts of this invention will be more clearly and fully set forth in the detailed drawings and description of examples which follow.

DRAWINGS

DESCRIPTION OF THE PREFERRED EMBODIMENTS

Figure 2:
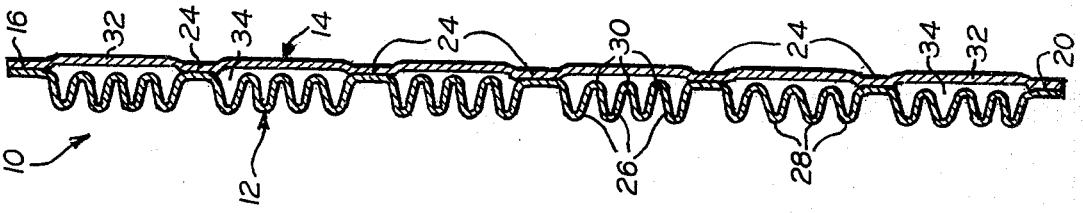
FIG. 2 is a sectional view taken along the line 2—2 of FIG. 1.
Figure 1:
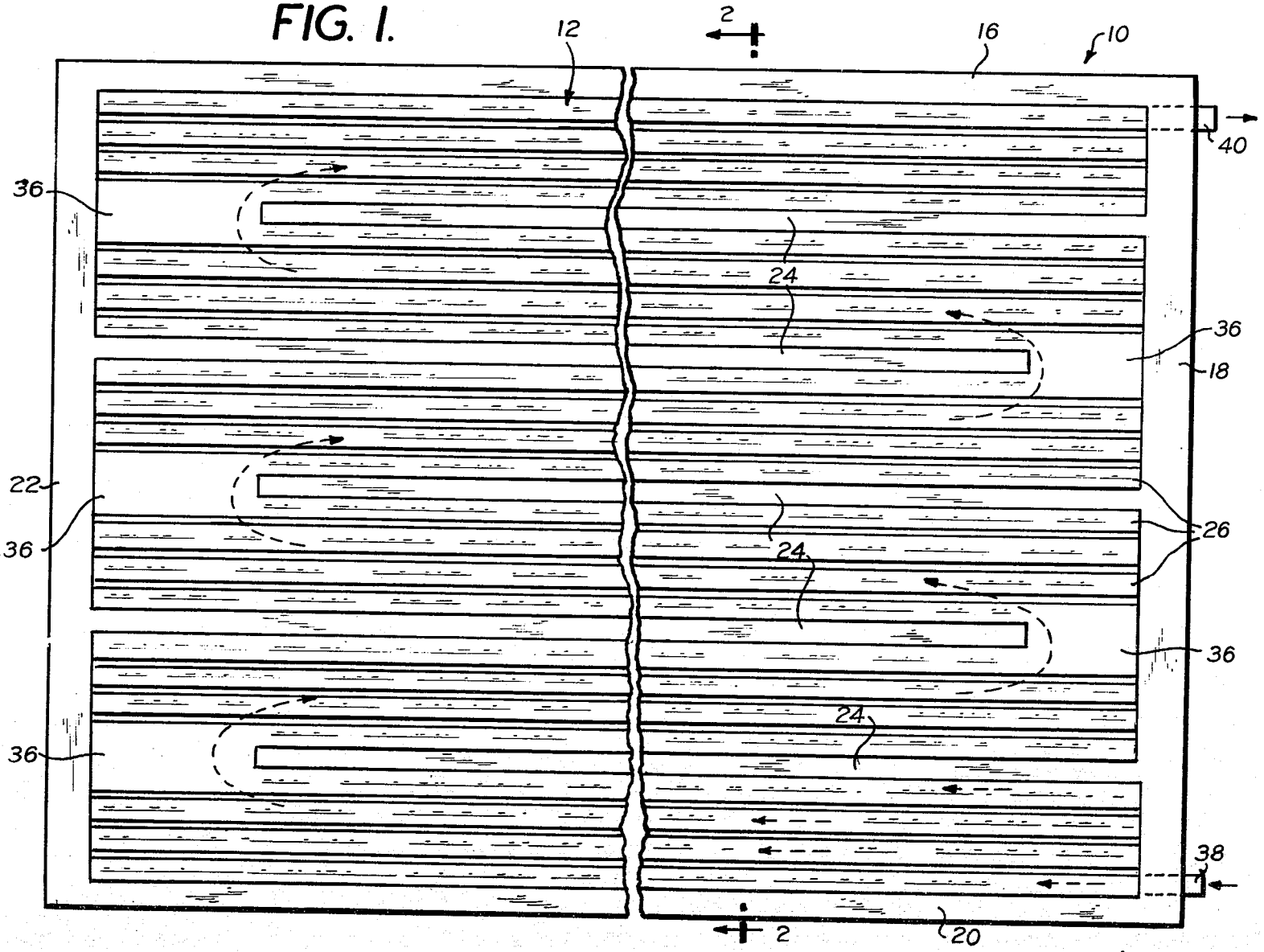
FIG. 1 is a plan view, with its center broken out, of a preferred embodiment of a panel-type heat exchanger constructed in accordance with this invention.
Figure 3:
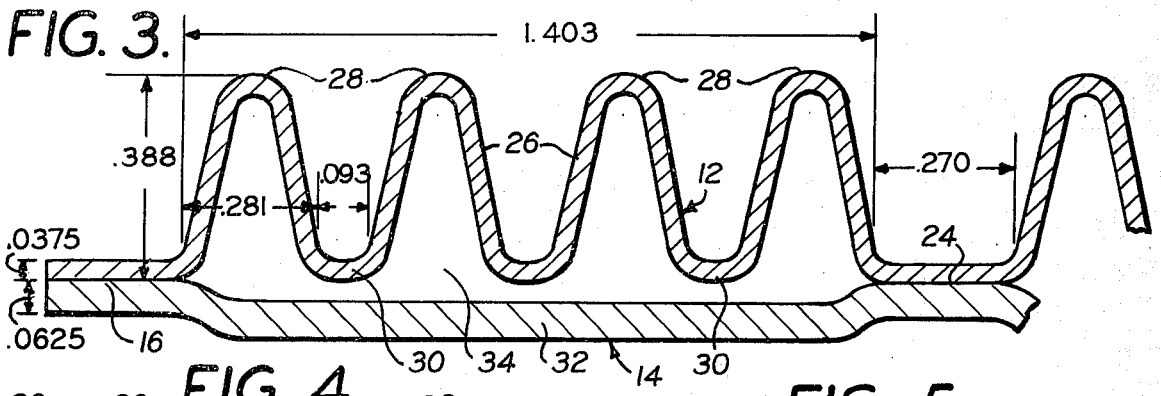
FIG. 3 is a partial sectional view of the heat exchanger of FIG. 1 shown in enlarged scale to illustrate clearly typical proportions of the structure.

The heat exchanger panel 10 as illustrated in FIGS. 1–3 is formed from metal sheets 12 and 14, preferably rectangular in shape and bonded together by conventional welding at panel edges 16, 18, 20 and 22, as well as along longitudinal strip sections 24.

As best seen in FIGS. 2 and 3, plate 12 is shaped between the sealed strips 24, into a plurality of parallel longitudinal open-looped fins 26, extending outwardly from the surface of plate 12, and terminating in smoothly rounded ends 28 and 30. In this manner multiple loops 26 form conduits through which heating or cooling fluid may freely pass in direct prime heat-exchanging contact with the entire inner surface of looped fins 26.

Second plate 14 is formed with outwardly depressed portions 32 between bonded edges 16, 20 and strips 24, complementary to looped fins 26 of plate 12 to create broad channel fluid passages 34. Open unsealed end passages 36 are provided to permit the sinuously reversing flow of heat-exchanger fluid throughout panel 10, from fluid entry port 38 to fluid exit port 40, in the path indicated by the dashed arrows of FIG. 1. A continuous pattern of prime heat-exchanging fluid contact and controlled flow is thereby achieved.

It should be understood, however, that the invention is not restricted to a sinuous flow pattern but lends itself as well to a series parallel or parallel flow patterns as used in other conventional heat exchangers.

FIG. 3 illustrates in detail the configuration of heat-exchanger panel 10 with typical illustrative dimensions added.

Figure 4:
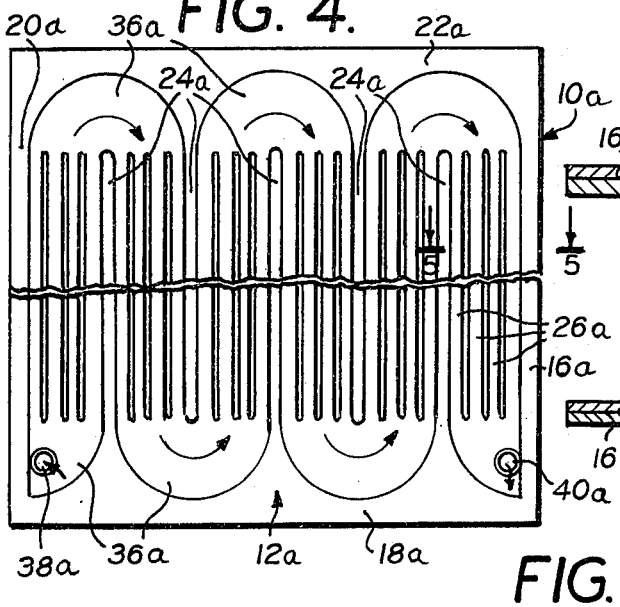
FIG. 4 is a plan view, partially broken out, of a second embodiment of this invention.
Figure 5:
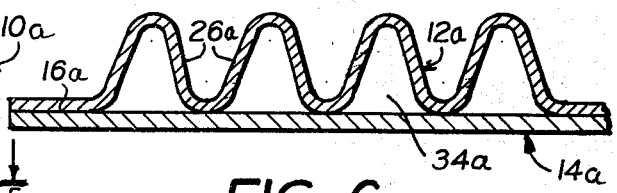
FIG. 5 is a partial sectional view taken along 5—5 of FIG. 4.

FIGS. 4 and 5 illustrate a heat-exchanger panel **10*a* with plate 12*a* formed into open-looped fins 26*a* between bonded plate edges 16*a*, 20*a* and bonded strip portions 24*a*. Plate 14*a* in this instance provides a flat backing surface for plate 12*a*, the combination forming fluid heat-exchange channels 34*a*. Return plenum end passages 36*a* of panels 12*a* and 14*a*, permit smoothly reversing flow of the heat exchanging fluid from entry port 38*a* to exit port 40*a***.

Figure 6:
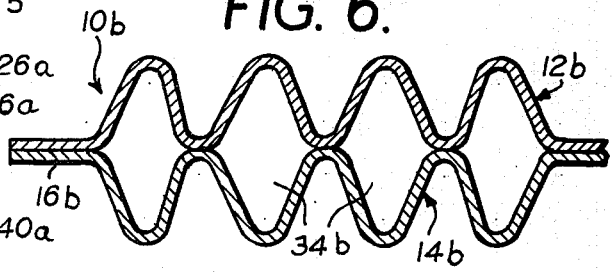
FIG. 6 is a partial sectional view of a modified form of the heat exchanger panel of FIGS. 4 and 5.

The heat exchanger panel embodiment **10*b* of FIG. 6 has open-looped finned plates 12*b* and 14*b* identical in configuration and abutting each other in mirror-image relationship, to provide maximum prime heat exchange surface to the contacting fluid passing through deep channels 34*b*** formed therebetween.

Figure 7:
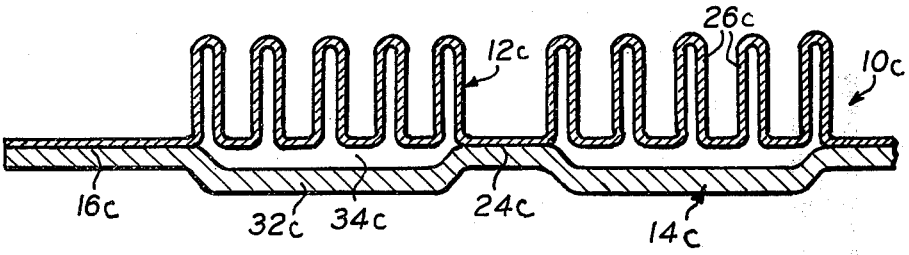
FIG. 7 is a partial sectional view of a modified form of the heat exchanger panel of FIGS. 1–3.

FIG. 7 shows a heat exchanger panel **10*c* similar to panel 10. In this embodiment, plate 14*c* is identical to plate 14 of the first embodiment, having outwardly depressed portions 32*c* formed between edge seals 16*c*, etc. and sealed strips 24*c*. The open-looped fins 26*c* of plate 12*c*** are shaped so that their side walls are parallel to each other and substantially perpendicular to the panel surface.

Figure 8:
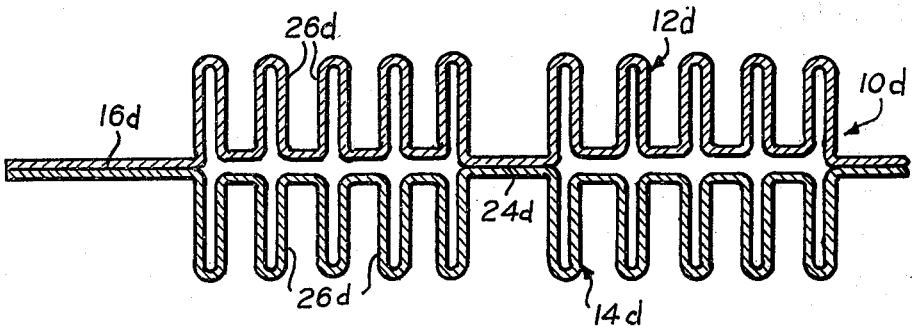
FIG. 8 is a partial sectional view of a still further embodiment of this invention.

Heat exchanger panel **10*d* in FIG. 8 has plates 12*d* and 14*d*, sealed at edge 16*d* and strips 24*d*. Both plates 12*d* and 14*d* have parallel-sided open-looped fins 26*d***, are identical in configuration, and are positioned in abutting mirror-image relationship.

The modification shown in FIGS. 7 and 8 is an improvement over my U.S. Pat. Nos. 2,434,519 and 3,251,410, and results in improved performance of plate-type heat exchangers.

The examples described above are illustrative of the concepts of this invention, and permit various contemplated modifications and combinations within its scope, defined only by the following claims.

What is claimed is:

1. A heat exchange panel formed from two superimposed rectangular plates bonded together along their edges and having an inlet and an outlet for circulating the heat exchange medium;

a. one of said plates being corrugated to form groups of easily cleanable, smoothly rounded open-looped undulating fins having a reduced tendency to become fouled and intervening flat portions;

b. the other one of said plates being substantially flat and sealed to the flat portions of said corrugated plate forming together therewith sealed strips separating said groups of open-looped undulating fins and sealed strips extending alternately from one bonded edge to a distance spaced from the opposite bonded edge to form open unsealed portions permitting the heat exchange medium to pass in heat exchange relationship successively through said groups of open-looped undulating fins in alternately reversed directions across the panel from the inlet to the outlet thereof;

c. said substantially flat plate having a depressed portion extending between each of said strips and being co-extensive in length with each of said groups of undulations and spaced from the undulations facing said depressed portions to provide direct prime heat exchange between the open-looped fins of each of said groups and expose virtually the entire inner heat exchange surface of the panel to such direct prime heat exchange contact with the medium therein and provide a panel having a heat capacity coefficient K of approximately 2.5 BTU per square foot of projected surface times the difference in temperature between the panel and the ambient air.

2. A heat exchange panel according to claim 1, wherein the bights of said undulations are rounded and the legs thereof extend alternately in a substantially parallel direction.

3. A heat exchange panel according to claim 1, wherein the bights of said undulations are substantially parallel and extend in a substantially perpendicular direction relative to said depressed portion.

4. A heat exchange panel according to claim 3, wherein the bights of said undulations facing said depressed portion comprise a straight portion.

* * * * *